US008008995B2

(12) United States Patent
Honda et al.

(10) Patent No.: US 8,008,995 B2
(45) Date of Patent: Aug. 30, 2011

(54) STRIPLINE FILTER AND MANUFACTURING METHOD THEREOF

(75) Inventors: Nobuyoshi Honda, Kanazawa (JP); Tatsuya Tsujiguchi, Ishikawa (JP); Yasunori Takei, Komatsu (JP)

(73) Assignee: Murata Manufacturing Co., Ltd., Nagaokakyo-Shi, Kyoto-Fu (JP)

( * ) Notice: Subject to any disclaimer, the term of this patent is extended or adjusted under 35 U.S.C. 154(b) by 0 days.

(21) Appl. No.: 12/794,084

(22) Filed: Jun. 4, 2010

(65) Prior Publication Data

US 2010/0265012 A1 Oct. 21, 2010

Related U.S. Application Data

(63) Continuation of application No. PCT/JP2008/072032, filed on Dec. 4, 2008.

(30) Foreign Application Priority Data

Dec. 19, 2007 (JP) ..... 2007-326842

(51) Int. Cl.
*H01P 1/205* (2006.01)
*H01P 1/203* (2006.01)
*H01P 7/08* (2006.01)

(52) U.S. Cl. ..... 333/203; 333/204; 333/219

(58) Field of Classification Search ..... 333/202–205, 333/219, 235

See application file for complete search history.

(56) References Cited

U.S. PATENT DOCUMENTS

| | | | | |
|---|---|---|---|---|
| 5,519,366 | A * | 5/1996 | Kaneko et al. | 333/204 |
| 5,521,564 | A | 5/1996 | Kaneko et al. | |
| 5,898,403 | A * | 4/1999 | Saitoh et al. | 343/700 MS |
| 2008/0224800 | A1 * | 9/2008 | Takei et al. | 333/204 |

FOREIGN PATENT DOCUMENTS

| | | |
|---|---|---|
| JP | 59-91003 | 6/1984 |
| JP | 1-305702 A | 12/1989 |
| JP | 7-66605 | 3/1995 |
| JP | 2002-335111 A | 11/2002 |

OTHER PUBLICATIONS

PCT/JP2008/072032 International Search Report dated Mar. 3, 2009.
PCT/JP2008/072032 Written Opinion dated Mar. 3, 2009.

* cited by examiner

*Primary Examiner* — Benny Lee
*Assistant Examiner* — Gerald Stevens
(74) *Attorney, Agent, or Firm* — Dickstein Shapiro LLP

(57) ABSTRACT

The element size of a stripline filter that achieves a high efficiency percentage with optional stable filter characteristics, is reduced. A stripline filter includes substantially L-shaped top surface resonant lines. The top surface resonant lines include connection electrode parts, first line parts, and second line parts. The connection electrode parts are formed so as to have a width greater than line widths of side surface resonant lines. Each line part faces an edge of a corner portion of a central top surface resonant line at an interval. An edge of each first line part on an edge side of a dielectric substrate, other than a connection portion with the connection electrode part, faces an edge of the dielectric substrate at an interval.

10 Claims, 3 Drawing Sheets

STRIPLINE FILTER AND MANUFACTURING METHOD THEREOF

CROSS REFERENCE TO RELATED APPLICATIONS

The present application is a continuation of International Application No. PCT/JP2008/072032, filed Dec. 4, 2008, which claims priority to Japanese Patent Application No. JP2007-326842, filed Dec. 19, 2007, the entire contents of each of these applications being incorporated herein by reference in their entirety.

FIELD OF THE INVENTION

The present invention relates to a stripline filter in which striplines are provided on a dielectric substrate, and a manufacturing method thereof.

BACKGROUND OF THE INVENTION

A stripline filter in which a stripline-type resonator is provided on a dielectric substrate, is used in various fields (e.g., see Patent Document 1).

Here, a configuration of an existing stripline filter will be described. FIG. 1 is a top perspective view of the stripline filter.

In the stripline filter 101 resonant lines 113A and 113B are formed on a top surface of a dielectric substrate 110. The resonant line 113A is a ¼ wavelength resonant line, and is connected to a ground electrode (not shown) on a bottom surface of the dielectric substrate 110 via an electrode 119A formed on the back surface in the drawing. The resonant line 113B is a ¼ wavelength resonant line, and is connected to the ground electrode (not shown) on the bottom surface of the dielectric substrate 110 via an electrode 119B formed on the front surface in the drawing. In the stripline filter 101, in order to reduce an element size, the resonant lines 113A and 113B have wide electrode parts 112A and 112B formed at edges of the substrate top surface, respectively so as to have substantially L shapes in which the resonant lines 113A and 113B are bent, whereby the lengths of the resonant lines 113A and 113B are extended.

Patent Document 1: Japanese Unexamined Utility Model Registration Application Publication No. 59-91003

In the stripline filter of the above configuration, the adjacent resonant lines are coupled to each other by causing straight portions thereof on the opposite sides of the corner portions of the L shapes to face each other. In this case, the interval between the resonant lines and the length by which the resonant lines face each other are determined in accordance with a coupling amount needed, and the resonator length of each resonant line needs to be set by the width of the wide electrode part. Thus, the element size expanded by the lengths of the wide electrode parts needs to be secured, and hence the reduction of the element size is limited.

In addition, when a plurality of filters are cut out of a single motherboard during manufacture, electrodes are formed on side surfaces after cutting of each filter. The accuracy for forming the electrodes on the side surfaces is likely to deteriorate when compared to that for forming electrodes on a top surface or a bottom surface of a dielectric substrate. Due to deviation of the electrode formed on the side surface, the width of a portion where an electrode on the top surface is connected to an electrode on the side surface, changes. Due to this change, a poor connection of the electrodes occurs or filter characteristics vary. Thus, there is a possibility that the efficiency percentage of products will be reduced.

Moreover, due to variation of the cutting position of dicing when cutting out each filter, the size of the wide electrode part of the resonant line greatly changes. Due to this, there is a possibility that the filter characteristics will vary and the efficiency percentage of products will be reduced. In addition, burring or peeling may occur at the electrode due to dicing. Due to this as well, there is a possibility that the filter characteristics will vary and the efficiency percentage of products will be reduced.

SUMMARY OF THE INVENTION

Therefore, an object of the invention is to provide: a stripline filter that achieves a high efficiency percentage with optional stable filter characteristics and can reduce an element size; and a manufacturing method thereof.

A stripline filter of the invention includes a ground electrode, a plurality of resonant lines, side surface lines, and an input/output electrode. At least one of the resonant lines has a substantially L shape and includes: a connection electrode part, a first line part, and a second line part. The connection electrode part is connected to the side surface line at an edge of the top surface of the dielectric substrate and formed so as to have a width greater than a line width of the side surface line. The first line part is provided so as to extend in parallel to the edge of the top surface of the dielectric substrate and connected to the connection electrode part at a side thereof. The second line part is perpendicularly connected to the first line part and is open at an end thereof. Further, the edge of the first line part on an edge side of the dielectric substrate, other than a connection portion with the connection electrode part, faces the edge of the dielectric substrate at an interval.

In such a configuration, the line length of the L-shaped resonant line can be extended and the length by which the resonant line faces the adjacent resonant line can also be extended. Thus, even though the element size of the stripline filter is small, a great resonator length and a great facing length can be obtained, and optional filter characteristics can be achieved. In addition, the connectivity with the side surface line can be secured by the wide connection electrode part, and the width of the connection portion does not change even when the side surface line is deviated. Further, because the edge of the first line part is spaced from the edge of the dielectric substrate, the electrode size of the first line part does not change even when the cutting position of dicing varies. Thus, variation of the filter characteristics can be reduced.

The ground electrode may include a plurality of electrode extension parts and an electrode central part. The electrode extension parts are electrodes to which the side surface lines are connected and that are provided at an edge of the bottom surface of the dielectric substrate so as to be spaced from each other across an electrode-unformed part. The electrode central part is provided at a center of the bottom surface of the dielectric substrate and surrounded by the electrode extension parts, the electrode-unformed part, and the input/output electrode. Because the edge of the electrode central part is spaced from the edge of the dielectric substrate on the bottom surface of the dielectric substrate as described above, the electrode size of the electrode central part does not change even when the cutting position of dicing varies. Thus, variation of the filter characteristics can be reduced.

At least one of the side surface lines may be separated from the plurality of resonant lines, and may have, at an end thereof, a corner portion located so as to be spaced at an interval from a corner portion formed by the first and second line parts. When such a side surface line exists, in the case where the first line part is exposed at the edge of the top surface of the dielectric substrate as in the existing art, there is a possibility that short circuit or stray capacitance occurs between the side surface line and the L-shaped resonant line. However, when the first line part is located so as to be spaced from the edge of the dielectric substrate as in the invention, a risk of short circuit is greatly reduced, and the capacitance value of stray capacitance is also greatly reduced.

The interval between the first line part and the edge of the dielectric substrate may be substantially equal to an upper limit of cutting errors of dicing. Due to this configuration, even if cutting errors of dicing are great, dicing does not reach the first line part, and the electrode size of the first line part does not change. Thus, the filter characteristics are stabilized. In addition, burring or peeling does not occur at the edge of the first line part.

A width of the connection electrode part at the edge of the top surface of the dielectric substrate may be substantially equal to an upper limit of positional errors of forming the side surface lines. Due to this configuration, even if positional errors of forming the side surface lines are great, the width of the portion where the connection electrode part is connected to the side surface line does not change. Thus, the filter characteristics are stabilized.

The sum of: the interval between the first line part and the edge of the dielectric substrate; and a line width of the first line part may be smaller than a line width of the second line part. Thus, the filter characteristics are stabilized while the element size is reduced.

The line width of the side surface line part may be narrower than the input/output electrode. Thus, the connectivity between the side surface line and the input/output electrode can be secured.

The plurality of resonant lines may be interdigitally coupled to each other. Thus, strong coupling between the resonators is obtained, and the band of the filter characteristics can be expanded. Note that, when ¼ wavelength resonant lines are interdigitally coupled to each other, an attenuation pole occurs on a high frequency side of a passband, and, when a ½ wavelength resonator and a ¼ wavelength resonant line are interdigitally coupled to each other, an attenuation pole occurs on a low frequency side of the passband.

The plurality of resonant lines may include a first ¼ wavelength resonant line, a ½ wavelength resonant line, and a second ¼ wavelength resonant line. Here, the first and second ¼ wavelength resonant lines are the resonant lines having the substantially L shape. The ½ wavelength resonant line is coupled to the first and second ¼ wavelength resonant lines. In this configuration, an attenuation pole can be formed on the low frequency side of the passband. Thus, the stripline filter can be used for application including an attenuation pole on a low frequency side of a wide passband.

The electrodes on the top surface of the dielectric substrate may be photosensitive electrodes, and the electrodes on the bottom surface and the side surface of the dielectric substrate may be non-photosensitive electrodes. Thus, the cost of the process for forming the ground electrode and the side surface lines can be reduced while the resonant lines that have a great effect on the filter characteristics are formed with high accuracy. In this case, even when the shape accuracy of the side surface lines is low or the accuracy of dicing is low, the filter characteristics are stabilized.

A manufacturing method of a stripline filter of the invention includes a division step and a side surface line forming step. The division step is a step of dividing a plate-shaped dielectric motherboard into a plurality of dielectric substrates. This dielectric motherboard is one in which a resonant line and a projecting electrode part are formed on a top surface and a ground electrode and an input/output electrode are formed on a bottom surface. The side surface line forming step is a step of forming side surface line by: printing a conductive paste on side surfaces of the dielectric substrates obtained by the division at the division step; performing drying; and performing burning.

According to the invention, the line length of the L-shaped resonant line can be extended and the length by which the resonant line faces the adjacent resonant line can also be extended. Thus, even when the element size of the stripline filter is small, a great resonator length and facing length can be obtained, and optional filter characteristics can be achieved. In addition, the connectivity with the side surface line can be secured by the wide connection electrode part, and the width of the connection portion does not change even when the side surface line is deviated. Further, since the edge of the first line part is spaced from the edge of the dielectric substrate, the electrode size of the first line part does not change even when the cutting position of dicing varies. Therefore, a high efficiency percentage can be achieved with optional stable filter characteristics, and the element size can be reduced.

Figure 1:
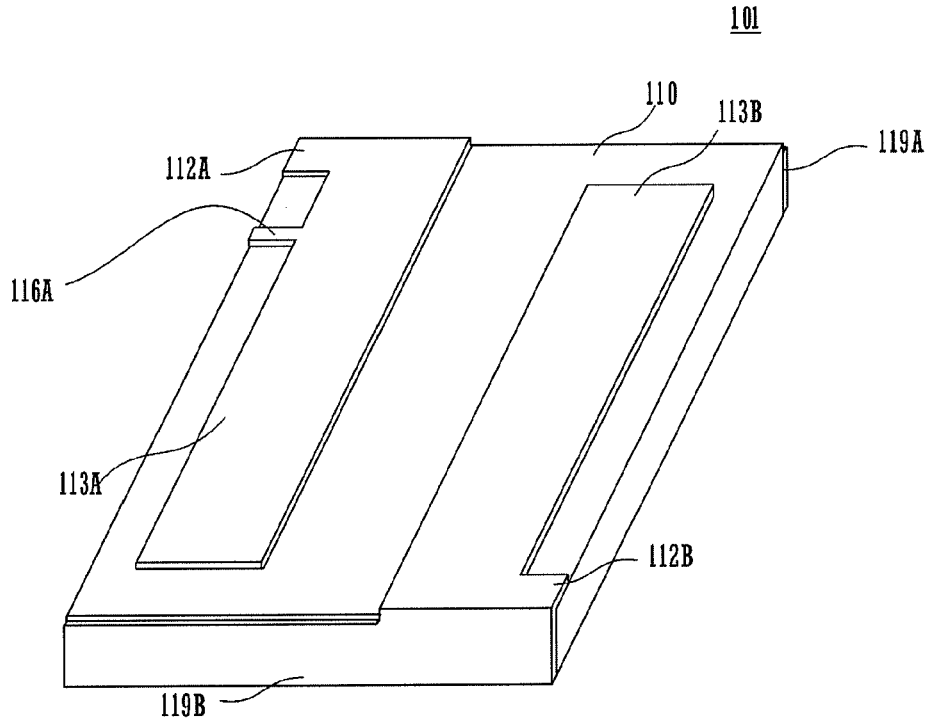
FIG. 1 PRIOR ART
FIG. 1 illustrates an example of a configuration of an existing stripline filter.

REFERENCE NUMERALS stripline filter
2, 3 glass layer
dielectric substrate
11A to 11D dummy electrode
12A to 12D side surface resonant line
13A to 13E top surface resonant line
14A, 14B side surface projecting electrode
15A, 15B connection electrode part
16A, 16B top surface line part
18A, 18B input/output electrode
19A, 19B electrode-unformed part
21A, 21B second line part
22A, 22B first line part
23A, 23B connection electrode part
ground electrode
24A electrode extension part
24B electrode-unformed part
24C electrode central part
25A, 25B top surface projecting electrode

DETAILED DESCRIPTION OF THE INVENTION

The following will describe an example of a configuration of a stripline filter according to an embodiment of the invention.

The stripline filter shown herein is a band-pass filter. The filter is used for UWB (ultra wide band) communication in a high frequency band equal to or higher than 4 GHz.

Figure 2:
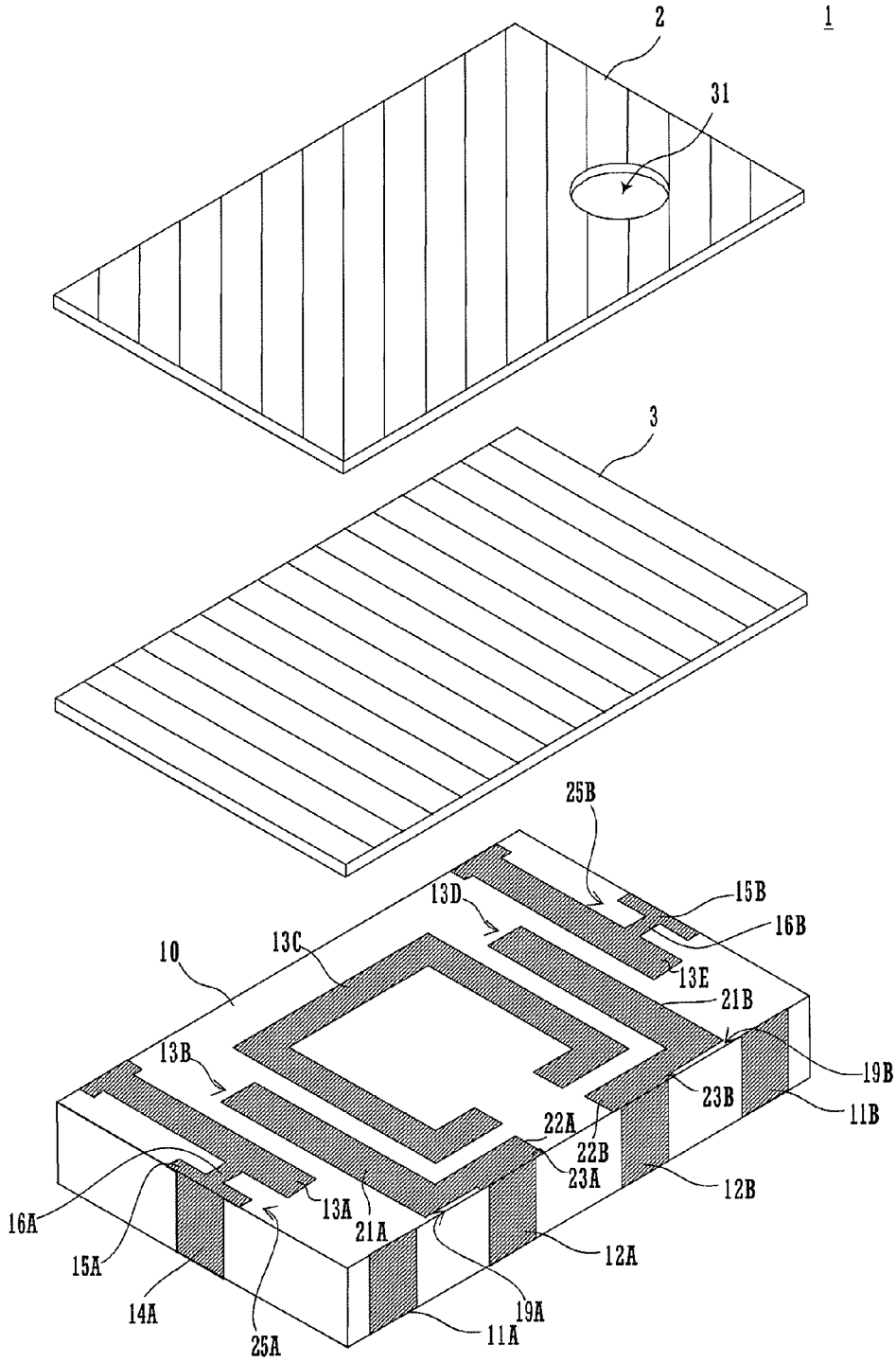
FIG. 2 is an exploded perspective view of a stripline filter according to an embodiment on its top surface side.
Figure 3:
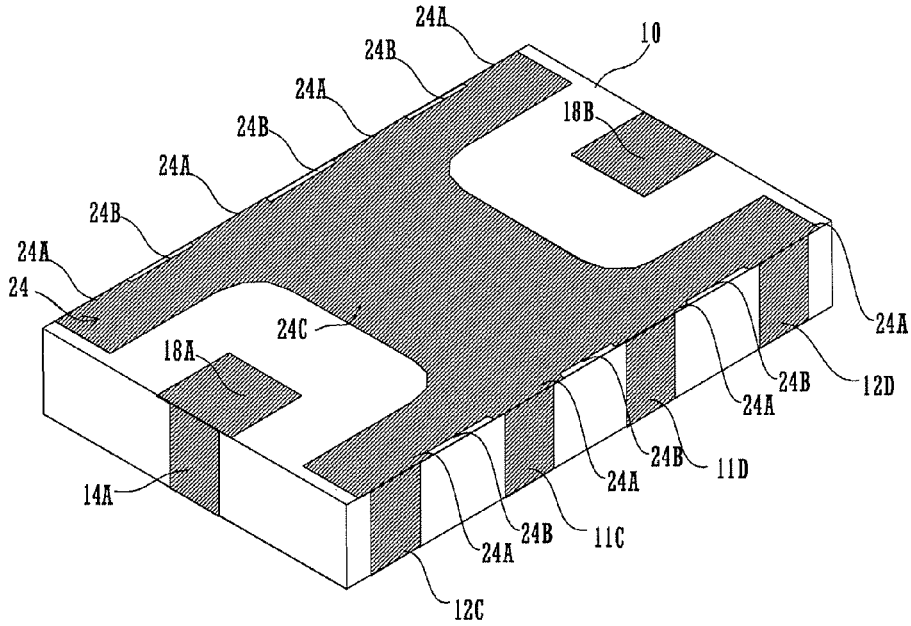
FIG. 3 is a perspective view of the stripline filter on its bottom surface side.

FIG. 2 is an exploded perspective view of the stripline filter on its top surface side. FIG. 3 is a perspective view of the stripline filter on its bottom surface.

The stripline filter 1 includes a dielectric substrate 10 and glass layers 2 and 3. Here, each of the glass layers 2 and 3 has a thickness of about 15 μm. The glass layers 2 and 3 are laminated on a top surface of the dielectric substrate 10, and contribute to mechanical protection and improvement of the environmental resistance, of the stripline filter 1. The glass layer 2 is laminated on the glass layer 3. Thus, a hole 31 can be formed as a marker in the glass layer 2, whereby the orientation of the stripline filter 1 can be visually recognized. Note that the glass layers 2 and 3 are not essential components, and may not be provided.

The substrate 10 is a small rectangular-parallelepiped-shaped, ceramic sintered substrate that is formed from titanium oxide and the like and has a relative dielectric constant of about 111. The composition and the dimension of the substrate 10 are set as appropriate by taking into consideration frequency characteristics and the like.

On the top surface of the substrate 10, top surface projecting electrodes 25A and 25B, and top surface resonant lines 13A to 13E that are resonant lines of the invention, are formed. These electrodes are silver electrodes each having a thickness of about 5 μm or greater, and are formed by: applying a photosensitive silver paste to the substrate 10; forming a pattern by a photolithographic process; and performing burning. By forming these electrodes as the photosensitive silver electrodes, the shape accuracy of the electrodes is increased to provide a stripline filter that can be used for UWB communication.

On a right near side surface (right side surface) of the substrate 10, dummy electrodes 11A and 11B and side surface resonant lines 12A and 12B, each of which is a side surface line of the invention, are formed. On a left far side surface (left surface) of the substrate 10 that is opposed to the right near side surface of the substrate 10, dummy electrodes 11C and 11D and side surface resonant lines 12C and 12D, each of which is a side surface line of the invention, are formed. See FIG. 3. These electrodes are silver electrodes each having a thickness of about 12 μm or greater, and are formed by: applying a non-photosensitive silver paste to the substrate 10 by using a screen mask or metal mask; and performing burning. Note that the electrode patterns on the right and left side surfaces of the substrate 10 are formed so as to have the same shape, thereby eliminating a need to control the orientation of the substrate 10 during a process of forming these electrode patterns. Note that the dummy electrodes 11A to 11D are provided in order to secure symmetry on the side surfaces, but these electrodes are not essential components and may not be provided.

On a left near side surface (front surface) of the substrate 10, a side surface projecting electrode 14A is formed. On a right far side surface (back surface) of the substrate 10 that is opposed to the left near side surface of the substrate 10, a side surface projecting electrode 14B (not shown) is formed. These electrodes are silver electrodes each having a thickness of about 12 μm or greater, and are formed by: applying a non-photosensitive silver paste to the substrate 10 by using a screen mask or metal mask; and performing burning. Note that the electrode patterns on the front and back surfaces of the substrate 10 are formed so as to be the same, thereby eliminating a need to control the orientation of the substrate 10 during a process of forming these electrode patterns.

The bottom surface of the substrate 10 (FIG. 3) is a mounted surface of the stripline filter 1, and a ground electrode 24 and input/output electrodes 18A and 18B are formed thereon. The input/output electrodes 18A and 18B are formed so as to be separated from the ground electrode 24. The input/output electrodes 18A and 18B are connected to high-frequency signal input/output terminals when the stripline filter 1 is mounted on a mounting substrate. The ground electrode 24 has a ground surface for a resonator, and is connected to a ground electrode on the mounting board. This bottom surface electrode pattern has silver electrodes each having a thickness of about 12 μm or greater, and are formed by: applying a non-photosensitive silver paste to the substrate 10 by using a screen mask or metal mask; and performing burning.

Each of the input/output electrodes 18A and 18B is provided at a position so as to contact the boundary between the bottom surface and the front or back surface. The widths of the input/output electrodes 18A and 18B at the boundaries are made larger than those of the side surface projecting electrodes 14A and 14B, thereby increasing the connectivity with the side surface projecting electrodes 14A and 14B and enhancing the electric insulation between the side surface projecting electrodes 14A and 14B and the ground electrode 24.

Note that the thickness of the electrodes on the side surfaces is made larger than the thickness of the electrodes on the top surface, whereby a current at a part, on the ground terminal side, where current crowding generally occurs is dispersed and conductor loss is reduced. Due to this configuration, the stripline filter 1 becomes an element having a small insertion loss.

On the top surface of the substrate 10 (FIG. 2), the top surface resonant lines 13A and 13E are connected to the side surface resonant lines 12C and 12D at the boundary between the left side surface and the top surface of the substrate 10, and further connected to the ground electrode 24 on the bottom surface via the side surface resonant lines 12C and 12D. In addition, their ends extend from the boundary toward the right side surface side, and are open.

The top surface resonant lines 13B and 13D are connected to the side surface resonant lines 12A and 12B at the boundary between the right side surface and the top surface of the substrate 10, and further connected to the ground electrode 24 on the bottom surface via the side surface resonant lines 12A and 12B. In addition, their ends extend from the boundary toward the left side surface side while bending twice, and are open.

The top surface resonant line 13C is located in the center of the substrate 10, and is a C-shaped electrode that is open on its right side surface side. In addition, its both ends are open.

These top surface resonant lines 13A to 13E face the ground electrode 24 on the bottom surface, and constitute a five-stage resonator in which they are interdigitally coupled to each other. Thus, the electromagnetic coupling between each resonator becomes strong, and expansion of the band of the filter characteristics can be achieved.

The following will describe a manufacturing process of the stripline filter 1.

Figure 4:
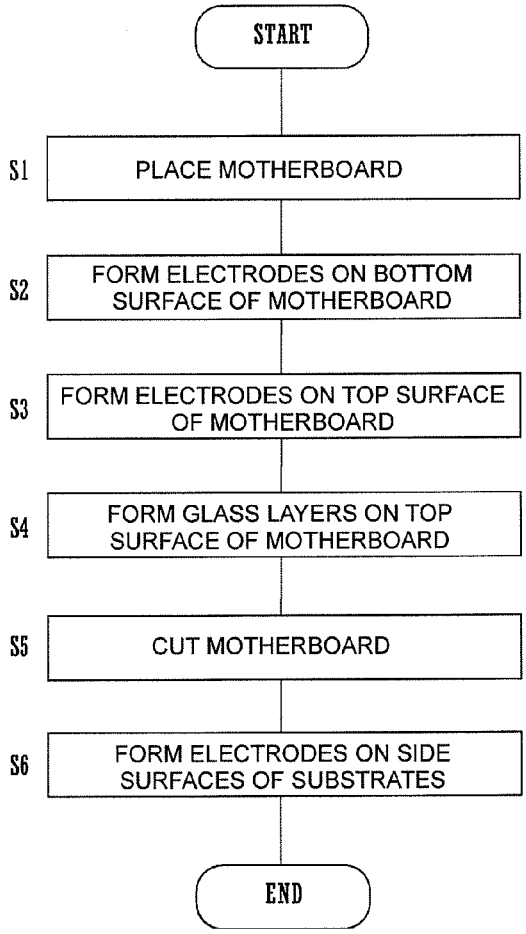
FIG. 4 illustrates a flow of a manufacturing process of the stripline filter.

FIG. 4 illustrates a flow of the manufacturing process of the stripline filter 1.

(S1) First, a dielectric motherboard is prepared in which no electrode is formed on any surface.

(S2) Next, a conductive paste is printed on a bottom surface of the dielectric motherboard by screen printing or metal mask printing, and burnt to form the ground electrode 24 and the input/output electrodes 18A and 18B.

(S3) Next, a photosensitive conductive paste is printed on a top surface of the dielectric motherboard, a photolithographic process involving exposure and development is performed, and then burning is performed to form the top surface resonant lines 13A to 13E, connection electrode parts 15A and 15B, and top surface line parts 16A and 16B. In the photolithographic process, the electrodes can be thinned to about 30 μm and can be formed with very high position accuracy.

(S4) Next, a glass paste is printed on the top surface side of the dielectric motherboard, and burnt to form a transparent glass layer. The glass layers 2 and 3 are formed by this process.

(S5) Next, multiple element assemblies are cut out of the dielectric motherboard configured thus, by dicing or the like.

(S6) Next, the element assemblies are arranged, a printing process is performed in which a conductive paste is printed by a metal mask or screen mask of a predetermined pattern, and burning is performed to form electrodes. By performing this printing process on each side surface, the side surface projecting electrodes 14A and 14B, the side surface resonant lines 12A to 12D, and the dummy electrodes 11A to 11D are formed. In this printing process, the electrodes can be thinned to merely about 100 μm and can be formed with merely low position accuracy as compared to that in the photolithographic process.

The stripline filter 1 is manufactured by the above process.

The following will describe a structure around the top surface resonant line 13B and 13D.

As shown in FIG. 2, the top surface resonant line 13B constituting the resonator of the second stage, and the top surface resonant line 13D constituting the resonator of the fourth stage, are substantially L-shaped electrodes that consist of connection electrode parts 23A and 23B, first line parts 22A and 22B, and second line parts 21A and 21B, respectively. The connection electrode parts 23A and 23B are provided so as to extend from the boundary between the right side surface and the top surface toward the left far (left side surface) side by a minute length. The first line part 22A is provided: so as to be connected to an end of the connection electrode part 23A; so as to bend from the end of the connection electrode part 23A in such a manner as to be orthogonal to the connection electrode part 23A; and so as to extend toward the left near (front surface) side of the dielectric substrate 10. The first line part 22B is provided: so as to be connected to an end of the connection electrode part 23B; so as to bend from the end of the connection electrode part 23B in such a manner as to be orthogonal to the connection electrode part 23B; and so as to extend toward the right near (back surface) side of the dielectric substrate 10. The second line parts 21A and 21B are provided so as to bend and extend from ends of the first line parts 22A and 22B toward the left side surface side.

The edges of the first line parts 22A and 22B on the left side surface side are parallel to and face the edge of the top surface resonant line 13C so as to be spaced therefrom at a predetermined interval. The edges of the second line parts 21A and 21B are parallel to and face the edge of the top surface resonant line 13C so as to be spaced therefrom at a predetermined interval. These intervals and facing lengths are set on the basis of a coupling amount needed between the resonators of the second stage and the third stage and a coupling amount needed between the resonators of the third stage and the fourth stage.

The edges of the first line parts 22A and 22B on the right side surface side, other than the connection portions with the connection electrode parts 23A and 23B, are parallel to and face the boundary between the top surface and the right side surface of the dielectric substrate so as to be spaced therefrom at a predetermined interval. Here, the widths of electrode-unformed parts 19A and 19B in their lateral direction are made smaller than the line widths of the first line parts 22A and 22B. Thus, the filter characteristics are stabilized while the element size is reduced.

In the above manufacturing process, due to positional errors when cutting out the dielectric substrate 10 by dicing, there is a possibility that dicing reaches the edges of the first line parts 22A and 22B. Thus, the above interval is made larger than the error range of dicing. Note that, when the above interval is made substantially equal to the upper limit of the errors of the dicing, the element size can be reduced while preventing dicing from reaching the edges of the first line parts 22A and 22B.

In the above manufacturing process, due to positional errors when forming the side surface resonant lines 12A and 12B as electrodes, there is a possibility that the lengths by which the connection electrode parts 23A and 23B are connected to the side surface resonant lines 12A and 12B, vary. Thus, the widths of the connection electrode parts 23A and 23B are made larger than the error range of forming the electrodes on the side surfaces. Note that, when the above interval is made substantially equal to the upper limit of the errors of forming the electrodes on the side surfaces, the element size can be reduced while eliminating the possibility that the connecting lengths vary.

Moreover, the dummy electrodes 11A to 11D are electrodes less necessary in terms of electric characteristics, but they are formed in order that the electrode patterns on the right and left side surfaces become the same. When the dummy electrodes 11A and 11B are provided, if it is configured such that the corner portions of the top surface resonant lines 13B and 13D are exposed to the edge of the dielectric substrate 10, there is a possibility that the dummy electrodes 11A and 11B and the top surface resonant line 13B, 13D are conducted to each other, or there is a possibility that a stray capacitance becomes excessive, due to the errors of forming the electrodes on the side surfaces. However, by spacing the corner portions of the top surface resonant lines 13B and 13D from the edge of the dielectric substrate 10 as in this configuration, such problems can be avoided.

The following will describe a structure around the top surface resonant lines 13A and 13E.

The top surface resonant line 13A constituting the resonator of the first stage and the top surface resonant line 13E constituting the resonator of the fifth stage, are connected to the input/output electrodes 18A and 18B via the top surface projecting electrodes 25A and 25B and the side surface projecting electrodes 14A and 14B. The top surface projecting electrodes 25A and 25B and the side surface projecting electrodes 14A and 14B constitute projecting electrodes. The side surface projecting electrodes 14A and 14B are connected to the input/output electrodes 18A and 18B on the bottom surface. As described above, the top surface resonant lines 13A and 13E are connected directly to the input/output electrodes 18A and 18B via the electrodes. Thus, the resonators of the input/output stages are tap-coupled to the input/output electrodes 18A and 18B, and strong external coupling is achieved.

The top surface projecting electrodes 25A and 25B consist of the top surface line parts 16A and 16B and the connection electrode parts 15A and 15B. The top surface line parts 16A and 16B are connected to the top surface resonant lines 13A and 13E. Each of the connection electrode parts 15A and 15B is provided from the boundary between the front surface or the back surface and the top surface, and are connected to the side surface projecting electrodes 14A and 14B and the top surface line parts 16A and 16B.

Where each line width of the top surface line parts 16A and 16B is W1; the width by which the connection electrode parts 15A and 15B contact the front surface and the back surface, respectively, is W2; and each line width of the side surface projecting electrodes 14A and 14B is W3, these dimensions meet W1<W3<W2.

Specifically, the widths of the connection electrode parts 15A and 15B are set by taking into consideration the errors of forming the side surface projecting electrodes 14A and 14B, and made larger than the sum of: a representative value of the errors of forming the side surface projecting electrodes 14A and 14B; and each line width of the side surface projecting electrodes 14A and 14B. Thus, regardless of the errors of forming the side surface projecting electrode 14A in each product, the side surface projecting electrodes 14A and 14B are connected to the connection electrode parts 15A and 15B throughout their line widths, and the connecting lengths become equal to the line widths of the side surface projecting electrodes 14A and 14B. Therefore, the connecting lengths almost do not vary, the external coupling amount is stabilized, and variation of the frequency characteristics becomes small, thereby improving the efficiency percentage of products.

In addition, the top surface line parts 16A and 16B can be set without taking into consideration the errors of forming the side surface projecting electrodes 14A and 14B, and the capacitance values between the top surface line parts 16A and 16B and the ground electrode 24 and the external coupling amount can be optionally set. Here, the line widths of the top surface line parts 16A and 16B are made thinner than the side surface projecting electrodes 14A and 14B and the connection electrode parts 15A and 15B. Thus, capacitances generated between the top surface line parts 16A and 16B and the ground electrode 24 are small. Note that, because the line widths of the side surface projecting electrodes 14A and 14B are made thinner than the connection electrode parts 15A and 15B, capacitances generated between the side surface projecting electrodes 14A and 14B and the ground electrode 24 are also small. Thus, strong external coupling is obtained in the stripline filter 1, and expansion of the band of the filter characteristics can be achieved. When weak external coupling is needed, the line widths of the top surface line parts 16A and 16B may be made thicker than the side surface projecting electrodes 14A and 14B.

Moreover, the projecting electrodes constituted of the connection electrode parts 15A and 15B and the side surface projecting electrodes 14A and 14B, are formed so as to extend through a central line of the substrate 10. Thus, the errors of forming the side surface projecting electrodes 14A and 14B are easily allowed. Note that the connection electrode parts 15A and 15B and the side surface projecting electrodes 14A and 14B are preferably formed such that their central lines agree with each other, but the central lines of the top surface line parts 16A and 16B may be deviated from each other.

The following will describe a structure around the ground electrode 24.

The ground electrode 24 is an electrode that consists of an electrode central part 24C and electrode extension parts 24A. The electrode central part is formed so as to be spaced at a predetermined interval from the boundaries with the right side surface and the left side surface of the dielectric substrate. The electrode extension parts 24A are provided between: the side surface resonant lines 12A to 12D and the dummy electrodes 11A to 11D; and the electrode central part 24C, and each electrode extension part 24A is spaced from other ones across electrode-unformed parts 24B.

The edge of the electrode central part 24C, other than connecting portions with the electrode extension parts 24A, face the boundaries between: the bottom surface; and the right side surface and the left side surface of the dielectric substrate, across the electrode-unformed parts 24B so as to be spaced at a predetermined interval. In the manufacturing process described before, there is a possibility that dicing reaches the edge of the electrode central part 24C, due to positional errors when cutting out the dielectric substrate 10 by dicing. Thus, the above interval is made larger than the error range of dicing.

The widths of the electrode extension parts 24A are made larger than the range of the errors of forming the electrodes on the side surfaces, because, in the manufacturing process described before, there is a possibility that the length by which each electrode extension part 24A is connected to the side surface line varies, due to positional errors when forming the side surface resonant lines as electrodes.

Due to the above configuration, in the stripline filter 1, the shapes of the top surface resonant lines 13B and 13D and the ground electrode 24 are stable even when dicing errors or errors of forming the electrodes on the side surfaces occur. In addition, the top surface resonant lines 13B and 13D and the ground electrode 24 are stably connected to the electrodes on the side surfaces even when errors of forming the electrodes on the side surfaces. Thus, a high efficiency percentage can be achieved with optional stable filter characteristics, and the element size can be reduced.

Note that the arranged positions and the shapes of the top surface resonant lines and the projecting electrodes in the above embodiment are according to the product specifications, and may be any arranged positions and shapes according to the product specifications. For example, in addition to the configuration in which a plurality of resonators are interdigitally coupled to each other, a configuration in which a plurality of resonators are comb-line coupled to each other, may be used. The invention is applicable to a configuration other than the above configuration, and can be used for pattern shapes of various filters. Further, another configuration (a high-frequency circuit) may be provided to the filter.

The invention claimed is:

1. A stripline filter comprising:

a dielectric substrate having a top surface, a bottom surface, and a side surface connecting the top and bottom surfaces;

a ground electrode provided on the bottom surface of the dielectric substrate;

a plurality of resonant lines provided on the top surface of the dielectric substrate;

side surface lines provided on the side surface of the dielectric substrate and connected to at least the ground electrode; and an input/output electrode provided on the bottom surface of the dielectric substrate, spaced from the ground electrode and coupled to any resonators formed by the resonant lines, wherein at least one of the resonant lines has a substantially L shape and includes:

a connection electrode part connected to one of the side surface lines at an edge of the top surface of the dielectric substrate and having a width greater than a line width of the side surface line;

a first line part extending parallel to the edge of the top surface and connected to the connection electrode part along a first portion thereof and separated from the edge of the top surface along a second portion thereof at an interval; and a second line part that is perpendicularly connected to the first line part and is open at an end thereof.

2. The stripline filter according to claim 1, wherein the ground electrode includes:

a plurality of electrode extension parts to which the side surface lines are connected and provided at an edge of the bottom surface of the dielectric substrate so as to be spaced from each other across an electrode-unformed part; and an electrode central part provided at a center of the bottom surface and surrounded by the plurality of electrode extension parts, the electrode-unformed part, and the input/output electrode.

3. The stripline filter according to claim 1, wherein at least one of the side surface lines is separated from the plurality of resonant lines, and has, at an end thereof, a corner portion located so as to be spaced at an interval from a corner portion formed by the first and second line parts.

4. The stripline filter according to claim 1, wherein the interval between the first line part and the edge of the top surface of the dielectric substrate is substantially equal to an upper limit of cutting errors of dicing.

5. The stripline filter according to claim 1, wherein a width of the connection electrode part at the edge of the top surface of the dielectric substrate is substantially equal to an upper limit of positional errors of forming the side surface lines.

6. The stripline filter according to claim 1, wherein the sum of: the interval between the first portion of the first line part and the edge of the top surface of the dielectric substrate; and a line width of the first line part is smaller than a line width of the second line part.

7. The stripline filter according to claim 1, wherein the plurality of resonant lines are interdigitally coupled to each other.

8. The stripline filter according to claim 1, wherein the plurality of resonant lines includes: a first ¼ wavelength resonant line that is included as one of the at least one of the resonant lines having the substantially L shape; a ½ wavelength resonant line that is coupled to the first ¼ wavelength resonant line; a second ¼ wavelength resonant line that is included as one of the at least one of the resonant lines having the substantially L shape and is coupled to the ½ wavelength resonant line.

9. The stripline filter according to claim 1, wherein the plurality of resonant lines on the top surface of the dielectric substrate are photosensitive electrodes, and the ground and input/output electrodes on the bottom surface and the side surface lines on the side surface of the dielectric substrate are non-photosensitive electrodes.

10. A method of manufacturing a stripline filter comprising a dielectric substrate having a top surface, a bottom surface, and a side surface connecting the top and bottom surfaces; a ground electrode provided on the bottom surface of the dielectric substrate; a plurality of resonant lines provided on the top surface of the dielectric substrate; side surface lines provided on the side surface of the dielectric substrate and connected to at least the ground electrode; and an input/output electrode provided on the bottom surface of the dielectric substrate, spaced from the ground electrode and coupled to any resonators formed by the plurality of resonant lines, wherein at least one of the resonant lines has a substantially L shape and includes a connection electrode part connected to one of the side surface lines at an edge of the top surface of the dielectric substrate and having a width greater than a line width of the side surface line, a first line part extending parallel to the edge of the top surface and connected to the connection electrode part along a first portion thereof and separated from the edge of the top surface along a second portion thereof at an interval, and a second line part that is perpendicularly connected to the first line part and is open at an end thereof, the method comprising:

dividing a dielectric motherboard into a plurality of dielectric substrates to obtain the dielectric substrate, the dielectric motherboard having the resonant lines formed on the top surface and the ground electrode and the input/output electrode formed on the bottom surface; and forming the side surface lines by printing a conductive paste on the side surfaces of the dielectric substrate obtained by the division at the division step.

* * * * *